US008557490B2

(12) United States Patent
Yasukawa et al.

(10) Patent No.: US 8,557,490 B2
(45) Date of Patent: Oct. 15, 2013

(54) CYAN TONER FOR DEVELOPING ELECTROSTATIC IMAGE

(75) Inventors: Hiroyuki Yasukawa, Tokyo (JP); Hajime Tadokoro, Kanagawa (JP); Kaori Matsushima, Tokyo (JP); Ito Koga, Tokyo (JP); Yohei Ohno, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 117 days.

(21) Appl. No.: 13/194,461

(22) Filed: Jul. 29, 2011

(65) Prior Publication Data

US 2012/0045718 A1 Feb. 23, 2012

(30) Foreign Application Priority Data

Aug. 19, 2010 (JP) ..... 2010-183552

(51) Int. Cl.
*G03G 9/09* (2006.01)

(52) U.S. Cl.
USPC ..... 430/108.3; 430/108.1; 430/108.2; 430/108.21; 430/108.24

(58) Field of Classification Search
USPC ..... 430/108.1, 108.2, 108.3, 108.21, 430/108.24
See application file for complete search history.

(56) References Cited

U.S. PATENT DOCUMENTS

| | | | | |
|---|---|---|---|---|
| 2007/0231729 | A1* | 10/2007 | Ohno et al. | 430/108.24 |
| 2008/0318144 | A1* | 12/2008 | Watanabe et al. | 430/48 |
| 2009/0291382 | A1* | 11/2009 | Hirose et al. | 430/108.21 |
| 2010/0159383 | A1 | 6/2010 | Obara et al. | |

FOREIGN PATENT DOCUMENTS

| | | | |
|---|---|---|---|
| JP | 2000-302993 | * 10/2000 | C09B 47/08 |
| JP | 2003-302792 | 10/2003 | |
| JP | 2009-122496 | 6/2009 | |
| JP | 2009-128750 | 6/2009 | |
| JP | 2009-129750 | 6/2009 | |
| JP | 2009-151162 | 7/2009 | |
| JP | 2009-180980 | 8/2009 | |

OTHER PUBLICATIONS

Translation of JP 2000-302993 published Oct. 2000.*
European Search Report EP 11 17 6517 (4 pages), mailed Nov. 21, 2011.

* cited by examiner

*Primary Examiner* — Peter Vajda
(74) *Attorney, Agent, or Firm* — Lucas & Mercanti, LLP

(57) ABSTRACT

Disclosed is a cyan toner for developing an electrostatic image containing a cyan colorant, and the cyan colorant comprises colorant compound X represented by Formula (1) and colorant compound Y represented by Formula (2).

Formula (1)

wherein $M^1$ is a metal atom of Group 14, Q is independently a monovalent substituent, m and n are each 0 or 1, at least one of m and n is 1, and A is independently an atomic group forming an aromatic ring which may have a substituent, Formula (2)

wherein, $M^2$ is Zn or Al, and A is independently an atomic group forming an aromatic ring which may have a substituent.

13 Claims, No Drawings

CYAN TONER FOR DEVELOPING ELECTROSTATIC IMAGE

This application is based on Japanese Patent Application No. 2010-183552 filed on Aug. 19, 2010, in Japanese Patent Office, the entire content of which is hereby incorporated by reference.

TECHNICAL FIELD

The present invention relates to a cyan toner for developing an electrostatic image for a use of an electrophotography.

BACKGROUND

Image quality of a color electrophotographic apparatus such as a copying apparatus or a printer has been progressed, and color reproduction by Japan Color 2003 as a standard color reproduction in the printing area color has been attained by a part of them.

However, color reproduction region in an image composed of each color toner of yellow, magenta and cyan does not cover color reproduction region on computer display screen completely. The technical barrier is caused by the difference of principal that while computer display screen is observed via additive color process by transmitted light, image formed via an electrophotography using color toners is observed via subtractive color process by reflected light. In particular, cyan colorants are restricted in its selection for demand of discoloration image storage property in an electrophotographic apparatus for office use in majority.

A copper phthalocyanine compound having copper in the center metal has been practically used as a cyan colorant, and the copper phthalocyanine compound was excellent in coloring characteristics of low brightness color in cyan region (deep and dark color), however coloring characteristics of high brightness color in cyan region (pale and bright color) was not sufficient.

For the purpose of improving the problem, Patent Document 1, for example, discloses cyan colorants containing phthalocyanine compound in which a substituent is bonded to a center metal atom, and the cyan colorants give a cyan toner for developing an electrostatic image having high brightness and good color tone in color cyan region.

Further technique using two or more compounds in combination has been provided to enhance the color reproduction property of both low brightness color in cyan region and high brightness color in cyan region.

For example, Patent Document 2 discloses a cyan pigment obtained by pulverizing copper phthalocyanine compound and nickel phthalocyanine compound in a wet state in a presence of inorganic salts and organic solvent, and high chroma can be obtained by the cyan pigment since it has smaller particle size in comparison with a method pulverizing a copper phthalocyanine compound singly.

Patent Document 3 discloses a cyan colorant containing a phthalocyanine compound in which a substituent is bonded to a center metal atom, and a phthalocyanine compound in which a substituent is not bonded to a center metal atom in a specific ratio.

However, toner exhibiting sufficient color reproduction property in low brightness color in cyan region as well as high brightness color in cyan region was not realized by employing two or more kinds of above described compounds as colorants by the detailed study of the inventor of the present invention.

PRIOR ART DOCUMENT

Patent Document 1: JP-A 2009-122496
Patent Document 2: JP-A 2009-151162
Patent Document 3: JP-A 2009-128750

SUMMARY

An object of the invention is to provide a cyan toner for developing an electrostatic image, by which a high color reproduction property is obtained in both of low brightness and high brightness of color in cyan region.

The cyan toner for developing an electrostatic image of the present invention comprises cyan toner particles containing a binder resin and a cyan colorant, wherein the cyan colorant comprises colorant compound X represented by Formula (1) and colorant compound Y represented by Formula (2).

Formula (1)

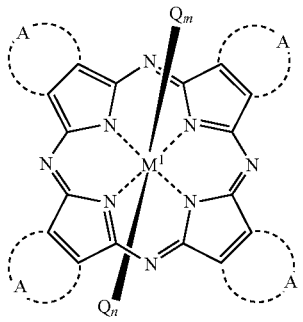

In Formula (1), $M^1$ is a metal atom of Group 14, Q is independently a monovalent substituent, m and n are each 0 or 1, at least one of m and n is 1, and A is independently an atomic group forming an aromatic ring which may have a substituent.

Formula (2)

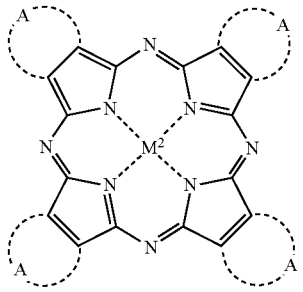

In Formula (2), $M^2$ is Zn or Al, and A is independently an atomic group forming an aromatic ring which may have a substituent.

$M^1$ in Formula (1) of colorant compound X is preferably Si, Ge or Sn, and in particular, Si is preferable.

Each of Q in Formula (1) is preferably an alkyl group, an aryl group, an aryloxy group, an alkoxy group, an acyloxy group or a group represented by Formula (3), independently.

Formula (3)

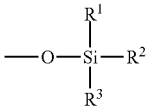

In Formula (3), $R^1$ through $R^3$ represents independently an alkyl group, an aryl group, an aryloxy group or an alkoxy group.

The cyan toner of the present invention preferably has a ratio of content by mass mX of the colorant compound X to content by mass mY of colorant compound Y, mX:mY of 95:5 to 5:95.

The cyan toner of the present invention comprises specific two types of colorant compounds in combination, and a high color reproduction property can be obtained both in low brightness color in cyan region and high brightness color in cyan region.

The reason is not clearly analyzed but is supposed as follows. Colorant compound X, one of the specific two specific colorant compounds, is composed of a phthalocyanine complex having a bond in perpendicular direction to a center metal atom, and while it is excellent in a color reproduction property of high brightness color without turbidity but brightness is too high and it does not exhibit sufficient chroma in low brightness color, since it has a sharp peak in the neighbor of wavelength of color in cyan region. Colorant compound Y having a peak at shorter wavelength than that of colorant compound X works complementarily and a color reproduction property is obtained in low brightness color.

Further, it is considered to contribute that colorant compound X and colorant compound Y form a small size pigment by forming a similar to a mixed crystal at a time of preparation of the cyan toner particles, and as the result, the cyan colorants are more homogeneously dispersed in the toner particles than that of each colorant used singly.

EMBODIMENT PRACTICING INVENTION

The invention is described in detail.

The cyan toner of the present invention comprises cyan toner particles containing a binder resin and cyan colorants described below.

Cyan Colorant

The cyan colorants composing the cyan toner comprises colorant compound X represented by Formula (1) and colorant compound Y represented by Formula (2).

Though the cyan colorant preferably consists of the colorant compound X and colorant compound Y, other cyan pigment or cyan dye may be contained as far as the cyan colorant contains colorant compound X and colorant compound Y in the cyan colorant in amount of for example, 80% by mass or more totally.

Colorant compound X is a compound having a bond from a center metal atom $M^1$ to a phthalocyanine ring in perpendicular direction. Colorant compound Y is a compound having no bond to phthalocyanine ring in perpendicular direction like a copper phthalocyanine. The term of "having a bond in perpendicular direction2 means that there is no bond in the same plan as the phthalocyanine ring, and it is not necessary that the bond be positioned at exactly 90° in colorant compound X.

Center metal atom $M^1$ in colorant compound X represented by Formula (1) is 14 group metal atom.

Specific examples of the center metal atom $M^1$ include Si, Ge, Sn and Pb, Si, Ge and Sn are preferable, and Si is preferable in particular, to obtain sufficient coloring characteristics of high brightness color in cyan region.

$M^2$ in Formula (2) is Zn or Al. Particularly Zn is preferable.

In Formula (1) Q is independently a monovalent substituent, specifically an alkyl group, an aryl group, an aryloxy group, an alkoxy group, an acyloxy group or a group represented by Formula (3) is preferable, and more preferably an alkyl group having 1 to 22 carbon atoms, an aryl group having 6 to 18 carbon atoms, an aryloxy group having 6 to 18 carbon atoms, an alkoxy group having 1 to 22 carbon atoms, an acyloxy group having 2 to 30 carbon atoms and a group represented by Formula (3) is included. Specifically, $—O(CH_2)_3CH_3$, $—OC_4H_9(t)$, $—O(CH_2)_5CH_3$, $—O(CH_2)_7CH_3$, $—OC_8H_{17}(t)$, $—OC_6H_5$, $—OCO—CH_2CH_2CH_3$, $—OSi(CH_3)_3$, $—OSi(CH_2CH_3)_3$, $—OSi(CH_2CH_2CH_3)_3$, and the like are included. The group represented by Formula (3) is preferably among them.

In Formula (3), $R^1$ and $R^3$ independently represents an alkyl group, an aryl group, an aryloxy group or an alkoxy group, preferably an alkyl group having 1 to 22 carbon atoms, an aryl group having 6 to 18 carbon atoms, an alkoxy group having 1 to 22 carbon atoms, or an aryloxy group having 6 to 18 carbon atoms, more preferably an alkyl group having 1 to 10 carbon atoms, an aryl group having 6 to 10 carbon atoms, an alkoxy group having 1 to 10 carbon atoms, or an aryloxy group having 6 to 10 carbon atoms, and particularly preferably, an alkyl group having 2 to 8 carbon atoms, an aryl group having 6 to 8 carbon atoms, an alkoxy group having 1 to 8 carbon atoms, an aryloxy group having 6 to 8 carbon atoms. Practically, a methyl group, an ethyl group, an n-propyl group, an iso-propyl group, an n-butyl group, an iso-butyl group, and a t-butyl group are preferable. Among these a methyl group is preferable and further most preferably all of $R^1$ and $R^3$ are a methyl group.

At least one of Q in Formula (1) is preferably any one of an alkyl group, an aryl group, an aryloxy group, an alkoxy group, an acyloxy group or a group represented by Formula (3), and more preferably two of Q's are any one of an alkyl group, an aryl group, an aryloxy group, an alkoxy group, an acyloxy group or a group represented by Formula (3). Particularly preferable Q is independently $—OC_4H_9(t)$, $—OC_8H_{17}(t)$, $—OSi(CH_3)_3$, $—OSi(CH_2CH_3)_3$ and $—OSi(CH_2CH_2CH_3)_3$.

In the Formula (1), m and n for Q are each 0 or 1, and at least one of m and n is 1. This means the colorant compound X has at least one bond in perpendicular direction to a phthalocyanine ring.

In the Formulas (1) and (2), four A's are independently an atomic group to form an aromatic ring which may have a substituent. Specific examples of the atomic group include (A-1) through (A-7). Preferable example is (A-1).

Examples of a substituent an atomic group A are an electron withdrawing group such as a chlorine atom, a halogen chloride methyl group ($—CClX_2$), wherein, X is a halogen atom, fluoro methyl group ($—CH_2F$), trifluoro methyl group ($—CF_3$) and a nitrogen group ($—NO_2$), an alkyl group having 4 to 8 carbon atoms such as t-butyl group, and an alkoxy group such as $—O(CH_2)_7CH_3$.

(A-1)

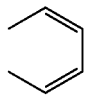

-continued
(A-2)
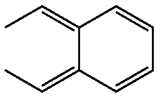
(A-3)
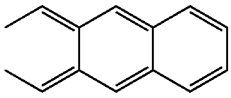
(A-4)
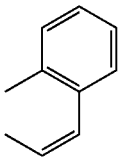
(A-5)
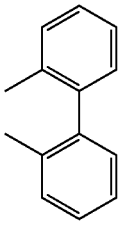
(A-6)
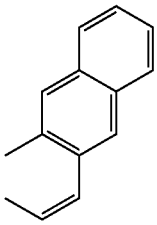
(A-7)
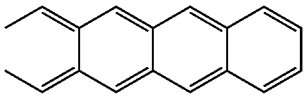
(A-1) to (A-7) may have a substituent.
Preferable examples of A in compounds represented by Formula (1) are listed.
(a-1)
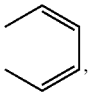
(a-2)
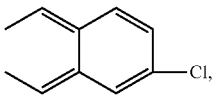
(a-3)
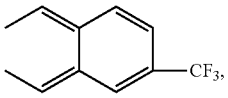
(a-4)
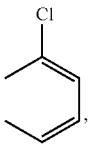
-continued
(a-5)
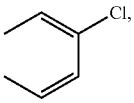
(a-6)
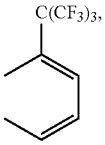
(a-7)
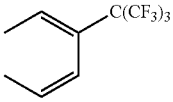
Among these, (a-1), (a-2) and (a-3) are particularly preferable.
The specific examples of the colorant compound X represented by Formula (1) include compounds represented by Formula (X-1) through Formula (X-6).
X-1
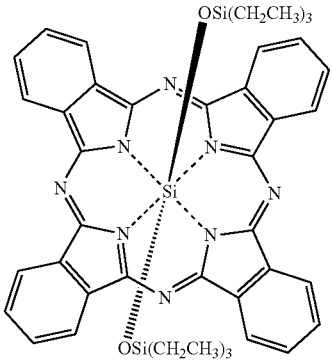
X-2
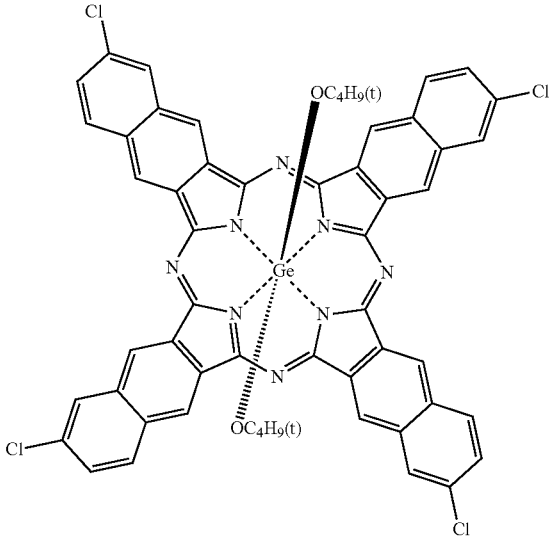

-continued
X-3
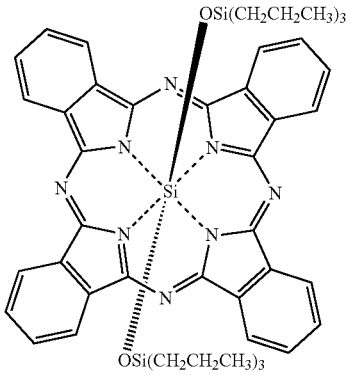
X-4
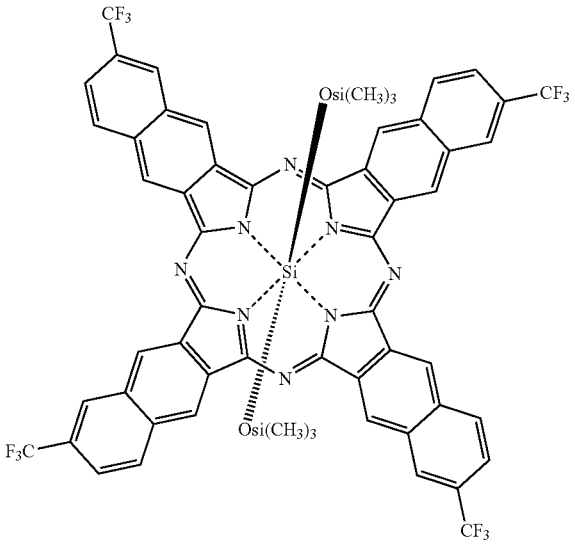
X-5
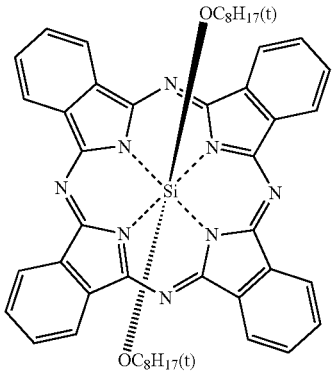
-continued
X-6
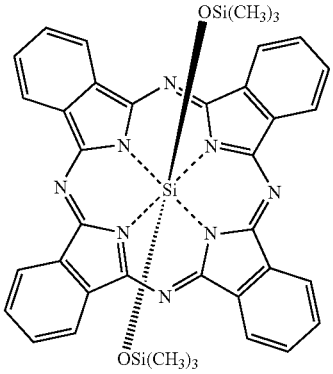
Particularly X-6 is preferable among these.
Particularly preferable examples of A in the compound represented by Formula (1) are listed.
(a-1)
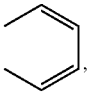
(a-8)
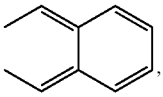
(a-9)
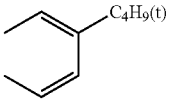
Specific examples of colorant compound Y represented by Formula (2) include compounds represented by Formula (Y-1) through Formula (Y-5).
Y-1
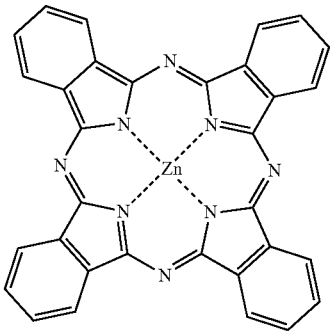

-continued

Y-2

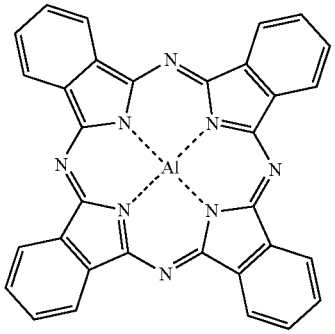

Y-3

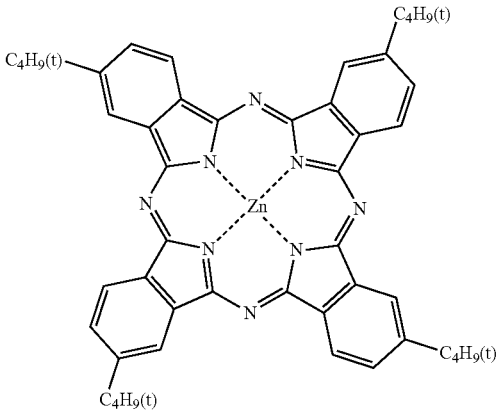

Y-4

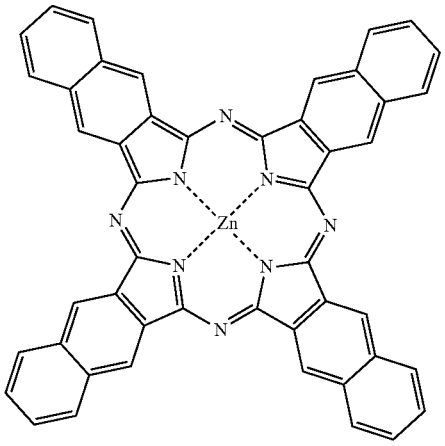

-continued

Y-5

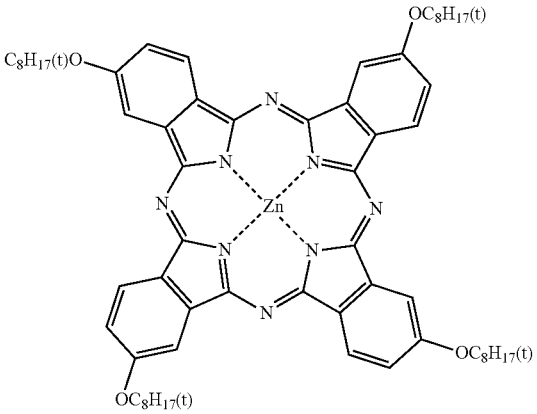

These compounds can be synthesized by a known method, U.S. Pat. Nos. 5,428,152, 4,927,735 and 5,021,563, for the compound represented by Formula (1), and C. C. Leznoff and A. B. P. Lever, Phthalocyanines-Properties and Applications, published by VCH for the compound represented by Formula (2).

The cyan toner of the present invention preferably has a ratio of content by mass mX of the colorant compound X to content by mass mY of colorant compound Y, mX:mY of 95:5 to 5:95, more preferably 80:20 to 20:80, and further preferably 70:30 to 0:70. High color reproduction property can be obtained throughout the low brightness color to high brightness color in cyan region when the above described ratio is satisfied.

High brightness color represents color of $55 \leq L^* \leq 80$ in L*a*b* color system, and low brightness color represents color of $30 \leq L^* \leq 55$. Color in cyan region represents color of hue angle between 180 and 240°.

The L*a*b* color representation system is useful means for representing color by numerical value, and L* represents the brightness in z-axis direction and a* and b* on x-axis and y-axis represent the hue and chromaticness. The brightness is relative brightness of color, and the chromaticness is degree of vividness of color. The hue is tone of color such as red, yellow, blue purple and the like, and is represented by hue angle. The hue angle is an angle of a line segment connecting a point of coordinates (a, b) and the origin of the coordinate axes O with a straight line extending to the plus-direction of x-axis in anticlockwise direction from the plus-direction of x-axis (red direction) on the plane of x-axis and y-axis representing the relation of the hue and the chromaticness when the brightness is a certain value. On the plane of x-axis and y-axis, the minus-direction of x-axis given by a* is direction of green and the plus-direction of y-axis given by b* is direction of yellow and the minus-direction of the y-axis is direction of blue.

Specifically, the L*a*b* for calculation of the hue angle is determined using the GRETAG MACBETH SPECTROLINO (manufactured by Gretag Macbeth) with conditions that D65 is used as a light source, an aperture of 4 mm in diameter for reflection measurement is used, at an interval of 10 nm in the range of 380 to 730 nm of the measuring wavelength, the viewing angle is set to 2 degrees, and an exclusive white the is used for a reference.

Content of the cyan colorants in the cyan toner particles is preferably 2 to 12% by mass and more preferably 4 to 8% by mass based on the mass of cyan toner particles.

Binder Resin

Concrete examples of such the binder resin include a styrene type resin, an acryl type resin such as alkyl acrylate and alkyl methacrylate, a styrene-acryl type copolymer resin and olefin type resin. The styrene type resin and acryl type resin having high transparency, low viscosity in melted state and sharp melting property is suitable for improving the transparency and the color reproducibility of the piled image. These resins may be used singly or in combination of two or more kinds thereof.

The cyan toner particles are preferably have a core shell structure which is composed of a core particle containing a binder resin and cyan colorants and a shell layer containing a binder resin and no cyan colorants covering the outer surface of the core particle. A resin composing the shell layer is preferably different from a resin composing the core particle in this instance. High productive stability and storage stability of the cyan toner particles are obtained when the cyan toner particles are composed of the core shell structure.

The core shell structure of the cyan toner particles include those which shell layer covers whole surface or part of the surface of core particle. A part of resins composed of the shell layer may form domain within the core particle. Further, shell layer may be composed of two or more layers each of which is composed of different resins respectively.

Such the binder resins preferably have a number average molecular weight (Mn) of from 3,000 to 6,000 and more preferably from 3,500 to 5,000, a ratio Mw/Mn of weight average molecular weight (Mw) to number average molecular weight (Mn) is from 2 to 6 and more preferably from 2.5 to 5.5, a glass transition point (Tg) of from 50 to 70° C. and more preferably from 55 to 70° C., which are determined for a THF soluble part via gel permeation chromatography.

Molecular determination via GPC is carried out as follows: namely, using apparatus "HLC-8220" (produced by Tosoh Corp.) and column "TSK guard column+TSK gel Super HZM-M (three in series)" (produced by Tosoh Corp.), as the column temperature is kept at 40° C., tetrahydrofuran (THF) as a carrier solvent is passed at a flow rate of 0.2 ml/min, and a measurement sample is dissolved in tetrahydrofuran so as for the concentration thereof to be 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). Subsequently, the molecular weight of the measurement sample is calculated using a calibration curve wherein the molecular weight distribution of the sample is determined employing a monodispersed polystyrene standard particle. As the standard polystyrene sample used to obtain the calibration curve, there are employed any of those featuring a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The calibration curve is drawn by connecting at least 10 points obtained via measurement using the standard polystyrene sample. Further, as a detector, the reflective index detector is utilized.

Softening Point of Cyan Toner

The cyan toner has preferably has a softening point of 75 to 112° C., more preferably 80 to 100° C.

Suitable melt states of the cyan toner can be obtained in fixing process when the cyan toner has such a softening point, and high color reproduction property can be obtained in secondary color.

The suitable melt states of the cyan toner means a state that a cyan colorant contained in the cyan toner and, for example, a magenta colorant contained in magenta toner are both homogeneously dispersed to form a color in a fixed color image region on the recording material wherein interface of mutual binder resin layer disappears and the cyan colorant does not spread outside of the color image region when a color image is formed by superposing a toner image of cyan toner and a toner image of different color toner.

The cyan toner forms a color image by using a yellow toner, a magenta toner, a black toner and the like in combination. The yellow toner, the magenta toner, and the black toner are preferably designed so that they have similar softening point, glass transition point, particle diameter etc., to the cyan toner.

The softening temperature is determined as follows: at first, 1.1 g of the cyan toner is placed in a Petri dish at ambiences of 20° C. and 50% RH, followed by being made even and by being allowed to stand for at least 12 hours, and thereafter a pressed sample of a 1 cm diameter columnar shape is prepared via compression at a compression pressure of 3,820 kg/cm$^2$ for 30 seconds using press instrument SSP-10A (produced by Shimadzu Corp.). Subsequently, using flow tester CFT-500D (produced by Shimadzu Corp.) at ambiences of 24° C. and 50% RH, the pressed sample is extruded through the columnar die orifice (1 mm diameter×1 mm) by use of a 1 cm diameter piston, starting at the time of the termination of preheating, under conditions of a weight of 196 N (20 kgf), an initial temperature of 60° C., preheating duration of 300 seconds, and a temperature increasing rate of 6° C./min. An offset method temperature $T_{offset}$, measured at an offset value of 5 mm via the melt temperature measurement method, being a temperature increasing method, is designated as the softening temperature.

Glass Transition Point of Cyan Toner

The glass transition temperature (Tg) of the cyan toner is preferably from 20 to 90° C., more preferably from 35 to 65° C.

Herein, the glass transition temperature (Tg) of the cyan toner is determined using differential scanning calorimeter DSC-7 (produced by Perkin Elmer, Inc.) and thermal analyzer controller "TAC7/DX" (produced by Perkin Elmer, Inc.). Specifically, 4.5 mg of the cyan toner is sealed in an aluminum pan (Kit No. 0219-0041) and placed in a DSC-7 sample holder. An empty aluminum pan is used as the reference measurement. Subsequently, heating-cooling-heating temperature control is carried out over a measurement temperature range of 0 to 200° C. under measurement conditions of a temperature increasing rate of 10° C./min and a temperature decreasing rate of 10° C./min. Measured data is obtained during the second heating stage, and then a glass transition point (Tg) is obtained as a value which is read at the intersection of the extension of the base line, prior to the initial rise of the first endothermic peak, with the tangent showing the maximum inclination between the initial rise of the first endothermic peak and the peak summit. Incidentally, during the first temperature increase, temperature is kept at 200° C. for 5 minutes.

Particle Diameter of Cyan Toner

In the toner of the present invention, the particle diameter of toner particles is preferably a volume-based median diameter of 4 to 10 μm, and more preferably 6 to 9 μm. The particle diameter of the toner particles can be controlled via the concentration of a coagulant, the addition amount of an organic solvent, or the fusing duration in the aggregation process, as well as via the composition of the polyester resins. When the volume-based median particle diameter satisfies above described value, there are reduced toner particles featuring high adhesion which adhere to the heating member via flight and cause fixing offset in the fixing process, and further transfer efficiency is enhanced, resulting in enhanced half-tone image quality as well as in enhanced fine-line and dot image quality.

The volume-based median diameter (D50v) of toner particles can be determined using COULTER MULTISIZER 3 (Beckmann Coulter, Inc.), connected to a computer system for data processing.

Specifically, 0.02 g of the cyan toner is added in 20 ml of a surfactant solution (being a surfactant solution prepared, for example, via ten-fold dilution of a neutral detergent containing a surfactant component with purified water to disperse a toner), followed by being wetted and then subjected to ultrasonic dispersion for 1 minute to prepare a toner dispersion. The toner dispersion is injected into a beaker, containing electrolyte solution "ISOTON II" (produced by Beckman Coulter, Inc.), set on the sample stand, using a pipette until the concentration indicated by the measuring apparatus reaches 8%. Herein, this concentration range makes it possible to obtain highly reproducible measurement values. Using the measuring apparatus, under conditions of a measured particle count number of 25,000 and an aperture diameter of 100 μm, the frequency is calculated by dividing a measurement range of 2 to 60 μm into 256 parts, and the particle diameter at a 50% point from the higher side of the volume accumulation ratio (namely the volume $D_{50}$% diameter) is designated as the volume-based median diameter.

Average Circularity of Cyan Toner

The cyan toner has average circularity of respective cyan toner particles composing the cyan toner of preferably 0.930 to 1.000, more preferably 0.950 to 0.995 in view of enhanced transfer efficiency. The circularity is calculated by the following formula.

Circularity={(circumference of a circle having the same projective area as a particle image)/(circumference of the projective area of the particle)}

Production Method of Cyan Toner

The method for producing the cyan toner of the present invention includes a kneading and pulverization method, a suspension polymerization method, an emulsion polymerization method, an emulsion polymerization and aggregation method, a mini emulsion polymerization and aggregation method, and an encapsulation method. Of these, the emulsion polymerization and aggregation method is preferably used, in consideration that it is necessary to obtain cyan toner composed of small-sized particles to achieve a high quality image in view of production cost and production stability.

The emulsion polymerization aggregation method is a production method of toner particles in which a dispersion of binder resin microparticles, having been produced via an emulsion polymerization method, is mixed with a dispersion of other toner particle constituents such as colorant particles, and then slowly aggregated while maintaining a balance between the repulsive force of the particle surface which is controlled by pH adjustment and the aggregation force which is controlled by addition of a coagulant composed of an electrolyte; and the resulting product is associated while controlling the average particle diameter and the particle size distribution, and simultaneously fusion among the particles is carried out via heat-stirring for shape controlling.

Such binder resin microparticles may be structured of at least 2 layers composed of binder resins having different compositions. In this case, there can be employed a method in which, in a dispersion of first resin microparticles having been prepared via an emulsion polymerization treatment (first-step polymerization) based on a common method, a polymerization initiator and a polymerizable monomer are added and then the resulting system is subjected to another polymerization treatment (second-step polymerization).

Cyan toner particles having core shell structure can be produced by, at first, preparing core particles are formed microparticles of a binder resin and colorant microparticles to form core particles by association, aggregation and fusion, then, the shell layer covering the surface of the core particles by adding resin microparticles to form shell layer are in the dispersion liquid of core particles, so that shell resin microparticles are formed on the surface of the core particles via aggregation, and fusion.

A practical example of the producing method of the cyan toner by the emulsion polymerization and aggregation method is described.

(1) Colorant microparticles dispersion liquid preparation process to obtain dispersion liquid of colorant microparticles in which colorant microparticles containing cyan colorants are dispersed in aqueous medium.

(2) Binder resin particle polymerization process to obtain binder resin particles, in which a polymerizable monomer liquid is prepared by dissolving or dispersing toner particle forming materials such as a releasing agent and a charge controller, if necessary, in a polymerizable monomer to form a binder resin, and the resulting solution is added in an aqueous medium to form oil droplets by applying mechanical energy, followed by conducting a polymerization reaction in the oil droplets, which is initiated by the radicals generated from a water-soluble radical polymerization initiator.

(3) Salting-out/aggregation/fusion process to form cyan toner particles, in which salting-out is conducted along with aggregation/fusion by adding a coagulant in an aqueous medium in which binder resin particles and colorant particles are dispersed, and by adjusting the temperature.

(4) Filtration/washing process to filter cyan toner particles from an aqueous medium and to remove substances such as a surfactant from the cyan toner particles;

(5) Drying process to dry cyan toner particles having been subjected to washing; and (6) Process to add an external additive to cyan toner particles having been subjected to drying.

The aqueous medium refers to a medium containing water at a content ratio of at least 50% by weight. As a component other than water, a water-soluble organic solvent is utilized, including, for example, methanol, ethanol, isopropanol, butanol, acetone, methyl ethyl ketone, and tetrahydrofuran. Of these, there is preferably utilized an alcohol based organic solvent such as methanol, ethanol, isopropanol or butanol which dissolves no resin.

In the preparation process of the colorant microparticles dispersion liquid, a dispersion of colorant particles, in which colorant particles are dispersed in an aqueous medium via mechanical energy, is prepared. Homogenizers to conduct oil droplet dispersion via mechanical energy are not specifically limited. Examples of a homogenizer include: "CLEAR MIX" (produced by M Technique Co., Ltd.) which is a homogenizer equipped with a high-speed rotating rotor, an ultrasonic homogenizer, a mechanical homogenizer, Manton Gaurin homogenizer and a pressure-type homogenizer.

With regard to colorant particles in a dispersion prepared in this colorant particle formation process, the volume median diameter thereof is preferably in the range of 20 to 1,000 nm, more preferably 20 to 140 nm and specifically preferably 30 to 100 nm.

The volume median diameter of colorant particles is controlled, for example, by adjusting the magnitude of the mechanical energy of the above homogenizer.

Surfactant

Surfactant may be added to the aqueous medium in the preparation process of colorant microparticles dispersion liquid and/or a binder resin microparticles polymerization process so as to disperse the microparticles aqueous medium stably. Various surfactant such as anionic type surfactant, cationic type surfactant and nonionic type surfactant can be used.

As the anionic surfactant, for example, a higher fatty acid salts such as sodium oleate; an alkylarylsulfonate such as sodium dodecylbenzenesulfonate; an alkylsulfate such as sodium laurylsulfate; a polyoxyethylene alkyl ether sulfate such as sodium polyoxyethoxyethylene lauryl ether sulfate; a polyoxyethylene alkylaryl ether sulfate such as sodium polyoxyethylene nonylphenyl ether sulfate; an alkylsulfosuccinate such as sodium monooctyl sulfosuccinate, sodium dioctylsulfosuccinate and polyoxyethylene laurylsulfosuccinate, and a derivative of them can be cited.

Further, the cationic surfactants include, for example, aliphatic amine salts, aliphatic quaternary ammonium salts, benzalkonium salts, benzethonium chloride, pyridinium salts, and imidazolinium salts.

As the nonionic surfactant, a polyoxyethylene alkyl ether such as polyoxyethylene lauryl ether and polyoxyethylene stearyl ether; a polyoxyethylene alkylphenyl ether such as polyoxyethylene nonylphenyl ether; a sorbitan higher fatty acid ester such as sorbitan monolaurate, sorbitan monostearate and sorbitan trioleate; a polyoxyethylenesorbitan higher fatty acid ester such as polyoxyethylenesorbitan monolaurate; a polyoxyethylene higher fatty acid ester such as polyoxyethylene monolaurate and polyethylene monostearate; a glycerol higher fatty acid ester such as oleic monoglyceride and stearic monoglyceride; and polyoxyethylene-polyoxypropylene block copolymer can be cited.

Polymerizable Monomer

Polymerizable monomer to form a binder resin used for a binder resin microparticles polymerization process wherein the binder resin includes vinyl polymer such as styrene resin, acryl resin, and styrene-acryl copolymer. Examples of the polymerizable monomer include;

Styrene and styrene derivative such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene;

Methacryl acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

Acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate;

Olefins such as ethylene, propylene and isobutylene;

Vinyl fluorides such as vinyl fluoride and vinylidene fluoride;

Vinyl esters such as vinyl propionate, vinyl acetate and vinyl benzoate;

Vinyl ethers such as vinyl methyl ether and vinyl ethyl ether;

Vinyl ketones: such as vinyl methyl ketone, vinyl ethyl ketone and vinyl hexyl ketone;

N-vinyl compounds such as N-vinyl compounds such as N-vinylcarbazole, N-vinylindole and N-vinylpyrrolidone;

Vinyl compounds such as vinylnaphthalene and vinylpyridine;

Acrylic acid or methacrylic acid derivatives such as acrylonitrile, methacrylonitrile and acrylamide.

These vinyl monomers can be used singly or two or more in combination.

Examples of such a monomer containing a carboxyl group include acrylic acid, methacrylic acid, maleic acid, itaconic acid, cinnamic acid, fumaric acid, maleic acid monoalkyl ester and itaconic acid monoalkyl ester. Examples of a monomer containing a sulfonic acid group include styrene sulfonic acid, allylsulfosuccinic acid, and 2-acrylamido-2-methylpropane sulfonic acid. Examples of such one containing a phosphoric acid group include acidphosphooxyethyl methacrylate.

A resin of a crosslinking structure can also prepare by using poly-functional vinyl compounds.

Examples Thereof are as Below:

divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylene glycol dimethacrylate, and neopentylene glycol diacrylate.

Releasing Agent

An appropriate releasing agent, contributing to prevent offset phenomena, may be incorporated in the cyan toner particles constituting the cyan toner of the present invention. Herein, the releasing agent is not specifically limited, including, for example, polyethylene wax, oxidized-form polyethylene wax, polypropylene wax, oxidized-form polypropylene wax, carnauba wax, Sasol wax, rice wax, candelilla wax, jojoba wax, and bees wax.

A method of incorporating a releasing agent into cyan toner particles includes a method wherein, in the salting-out/aggregation/fusion process to form cyan toner particles, a dispersion of releasing agent particles (a wax emulsion) is added to allow binder resin particles, colorant particles, and releasing agent particles to undergo salting-out, aggregation, and fusion; and a method wherein, in the salting-out/aggregation/fusion process to form cyan toner particles, binder resin particles and colorant particles containing a releasing agent are allowed to undergo salting-out, aggregation, and fusion. These methods may be employed in combination.

The content ratio of a releasing agent in cyan toner particles is commonly 0.5 to 5 parts by mass, preferably 1 to 3 parts by mass based on 100 parts by mass of a binder resin. When the content ratio of the releasing agent is less than 0.5 part by mass based on 100 parts by mass of the binder resin, the offset preventing effect becomes insufficient. In contrast, in cases of more than 5 parts by mass based on 100 parts by mass of the binder resin, a cyan toner obtained tends to exhibit poor translucency and poor color reproducibility.

Charge Controlling Agent

A positive or negative charge controlling agent can be used in the cyan toner. The charge controlling agent is preferably colorless.

Amount of the charge controlling agent used in the cyan toner particles is preferably 0.01 to 30 parts by mass and more preferably 0.1 to 10 parts by mass based on 100 parts by mass of a binder resin of the cyan toner particles.

The charge controlling agent can be incorporated by the same method as a method incorporating a releasing agent.

Polymerization Initiator

Polymerization initiators can be used in the binder resin microparticles polymerization process. Specific examples of the polymerization initiator include a persulfate such as potassium persulfate and ammonium persulfate, an azo type compound such as 4,4'-azobis-4-cyanovaleric acid and its salt and 2,2'-azobis(2-amidinopropane salt, and a peroxide compound.

Chain Transfer Agent

In a binder resin microparticles polymerization process, any commonly used chain transfer agent can be employed to control the molecular weight of a binder resin. Examples of the chain transfer agent include, 2-chloroethanol, a mercaptan such as 2-chloroethanol, octylmercaptan, dodecylmercaptane and t-dodecylmercaptane, and styrene dimer can be cited.

Binder resin microparticles prepared in dispersion liquid by binder resin microparticles polymerization process preferably has volume-based median diameter of 50 to 300 nm.

Coagulant

A coagulant used in the salting out, aggregation or fusion process, includes an alkaline metal salt and an alkaline earth metal salt are usable. Lithium, potassium and sodium are cited as the alkaline metal constituting the coagulant, and magnesium, calcium, strontium and barium are cited as the alkaline earth metal constituting the coagulant. Among them, potassium, sodium, magnesium, calcium and barium are preferable. As the counter ion (cation constituting the salt) of the alkaline metal and the alkaline earth metal, chloride ion, bromide ion, iodide ion, carbonate ion and sulfate ion are applicable.

External Additive

The cyan toner may be prepared by adding a fluidizing agent and a cleaning aid s so called as post-treating agent to the cyan color particles for improving the fluid ability, charging property and cleaning suitability, although the cyan color particles may be used as a cyan toner without any treatment.

As the external additive, for example, an inorganic oxide fine particle such as fine particle of silica, alumina and titanium oxide; a fine particle of metal stearate such as fine particle of aluminum stearate and zinc stearate; and a fine particle of inorganic titanate such as a fine particle of strontium titanate and zinc titanate are cited. These particles may be used singly or in combination of two or more kinds thereof.

These inorganic particles are preferably treated on the surface thereof by a silane coupling agent, a titanium coupling agent, a higher fatty acid or silicone oil for improvement in the storage ability against heating and the stability against environmental condition.

The adding amount of such the external additives is from 0.05 to 5, and preferably from 0.1 to 3, parts by weight in total to 100 parts by weight of the cyan toner. The various combinations of the external additives may be applied.

Developer

The cyan toner of the invention may be used not only as non-magnetic one-component developer but also a two-component developer by mixing with a carrier. When the cyan toner of the invention is used as the two-component developer, a magnetic particle composed of a metal such as iron, ferrite and magnetite and an alloy composed of such the metal and aluminum can be used as the carrier, and the ferrite particle is particularly preferable.

A coated carrier composed of the magnetic particle coated with a coating material such as a resin and a binder type carrier composed of binder resin in which the magnetic particles are dispersed may also be used as the carrier.

As the coating resin constituting the coated carrier, for example, an olefin type resin, styrene type resin, styrene-acryl type resin, silicone type resin, ester type resin and fluororesin are cite though the resin is not specifically limited. As the resin constituting the resin dispersion type carrier, for example, a styrene-acryl type resin, polyester resin, fluororesin and phenol resin are usable.

The volume-based median diameter of the carrier is preferably from 20 to 100 μm and more preferably from 20 to 60 μm. The volume-based median diameter of the carrier can be typically determined by a laser diffraction particle size distribution measuring apparatus having a wet type disperser HEROS, manufactured by Sympatec GmbH.

As a preferable carrier, from the viewpoint of anti-spent properties, cited are coated carriers employing a silicone resin, a copolymer (a graft resin) of organopolysiloxane and a vinyl monomer, or a polyester resin as a coating resin. Specifically, from the viewpoint of durability, environmental stability, and anti-spent properties, cited is a carrier coated with a copolymer of organopolysiloxane and a vinyl monomer (a graft resin), the copolymer being further reacted with an isocyanate.

EXAMPLES

Specific examples of the present invention will now be described.

Cyan Toner Production Example 1

Pulverization Method

The toner composition described below was placed in a HENSCHEL MIXER (produced by Mitsui-Miike Kogyo Co., Ltd.) and mixed with stirring at a blade-circumferential speed of 25 msec for 5 min.

| | |
|---|---|
| Polyester resin (condensation product of bisphenol A-ethylene oxide adduct, terephthalic acid and trimellitic acid) (weight average molecular weight 20,000) | 100 parts by mass |
| Compound represented by Formula (X-1) | 2 parts by mass |
| Compound represented by Formula (Y-1) | 2 parts by mass |
| Pentaerythritol tetrastearate as a releasing agent and | 6 parts by mass |
| Boron dibenzilic acid complex as a charge controlling agent | 1 part by mass of |

The resulting mixture was kneaded in a biaxial extrusion kneader, roughly pulverized in a hammer mill, further pulverized in a turbo-mill (produced by TURBO KOGYO Co., Ltd.), and subjected to powder classification in an air classifier employing Coanda effect to obtain cyan toner particles [1] having a volume-based median diameter of 5.5 μm.

Next, the following external additives were added to the resulting colored particles, and subjected to external treatment in a HENSCHEL MIXER (produced by Mitsui-Miike Kogyo Co., Ltd.).

| | |
|---|---|
| Hexamethylsilazane-treated silica (an average primary particle size of 12 nm | 0.6 parts by mass |
| n-Octylsilane-treated titanium dioxide (an average primary particle size of 24 nm) | 0.8 parts by mass |

The treatment with external additive in the HENSCHEL MIXER was conducted at 35° C. for 15 minutes under condition of a stirring blade circumferential speed of 35 msec, and Cyan Toner [1] was produced.

Preparation of Colorant Microparticles Dispersion Liquid [1]

Sodium n-dodecyl sulfate of 11.5 parts by mass was poured in 160 weight parts of deionized water and dissolved with stirring to prepare an aqueous surfactant solution, and, while stirring, 7 parts by mass of compound represented by Formula (X-2) and 3 parts by mass of compound represented by Formula (Y-2) were added gradually, then, dispersed using CLEAR MIX W-motion CLM-0.8 (produced by M Technique Co.) to obtain colorant microparticles dispersion liquid [1] in which colorant microparticles were dispersed.

Colorant microparticles contained in the colorant particles dispersion liquid [1] exhibited a volume-based median diameter of 89 nm. The volume-based median diameter was measured under the following conditions using MICROTRAC UPA-150 (produced by HONEYWELL Corp.).

Measuring Condition sample refractive index: 1.59 sample specific gravity: 1.05 (in terms of a spherical particle)

solvent refractive index: 1.33 solvent viscosity: $0.797\times10^{-3}$ Pa·s at 30° C. and $1.002\times10^{-3}$ Pa·s at 20° C.

zero-point adjustment was conducted by placing ion-exchanged water in a measuring cell.

Preparation of Colorant Microparticles Dispersion Liquids 2 to 16

Colorant microparticles dispersion liquid [2] through [16] were prepared in the same manner as preparation of colorant microparticles dispersion liquid [1], except that species of compounds of colorant compound X and colorant compound Y and their amount were changed as described in Table 1.

In Table 1, P.B. 15:3 represents C.I. Pigment Blue 15:3. P.B. 15:3 is not colorant compound X represented by Formula (1), and was used for comparison with the colorant compound X or Y according to the invention.

Preparation Example of Resin Microparticles Dispersion Liquid 1

A 5,000 ml separable flask fitted with a stirrer, a thermal sensor, a cooling pipe, and a nitrogen introducing unit was charged with a surfactant solution having been prepared by dissolving 7.08 g of an anionic surfactant (sodium dodecylbenzenesulfonate: SDS) in 2,760 g of ion-exchanged water, and while stirring at a stirring rate of 230 rpm under a nitrogen flow, the interior temperature was elevated to 80° C. Meanwhile, 72.0 g of the compound represented by Compound (W) to be described later, 115.1 g of styrene, 42.0 g of n-butyl acrylate, and 10.9 g of methacrylic acid were mixed, followed by being dissolved by heating to 80° C. to prepare a monomer solution. Then, using a mechanical homogenizer equipped with a circulatory path, the above 2 heated solutions were mixed and dispersed to prepare dispersion liquid of emulsified particles having a uniform dispersion particle diameter.

Subsequently, there was added a solution having been prepared by dissolving 0.84 g of a polymerization initiator (potassium persulfate: KPS) in 200 g of ion-exchanged water, followed by heating at 80° C. for 3 hours while stirring to prepare latex by the 1st step polymerization. Thereafter, there was further added to the latex a solution having been prepared by dissolving 8.00 g of a polymerization initiator (KPS) and 10.0 g of 2-chloroethanol, as a water-soluble chain transfer agent, in 240 g of ion-exchanged water, and after a lapse of 15 minutes, a liquid mixture (a second monomer solution) of 383.6 g of styrene, 140 g of n-butyl acrylate, and 36.4 g of methacrylic acid was dripped over 120 minutes at 80° C. After dripping, heating was carried out for 60 minutes while stirring, followed by being cooled to 40° C. to give dispersion [LX-1] of resin microparticles.

Formula (W): $C\{CH_2OCO(CH_2)_{20}CH_3\}_4$

Cyan Toner Production Example 2

Emulsion Polymerization and Aggregation Method

A 5,000 ml four-neck flask fitted with a thermal sensor, a cooling pipe, a nitrogen introducing unit, and a stirrer was charged with 1,250 g of binder resin particle dispersion [LX-1], 2,000 g of ion-exchanged water, and 165 g of colorant microparticles dispersion liquid [1], and then the resulting mixture was stirred to prepare liquid for aggregation. After adjusting temperature to 30° C., a 5 mol/l sodium hydroxide aqueous solution was added to this solution to adjust the pH to 10.0. Subsequently, an aqueous solution, having been prepared by dissolving 52.6 g of magnesium chloride hexahydrate in 72 g of ion-exchange water, was added to the reaction system at 30° C. over 10 minutes while stirring.

Subsequently, after a lapse of a standing time of 3 minutes, temperature elevation was initiated and then the reaction system was heated to a liquid temperature of 90° C. over 6 minutes (temperature elevation rate=10° C./minute). In this state, the particle diameter was determined using "Coulter Counter TA-III" (produced by Beckman Coulter, Inc.). When the volume median diameter reached 6.5 μm, an aqueous solution, having been prepared by dissolving 115 g of sodium chloride in 700 g of ion-exchanged water, was added to terminate particle growth, and heating was continuously conducted at a liquid temperature of 90° C.±2° C. for 6 hours while stirring to carry out fusing. Thereafter, the reaction system was cooled to 30° C. under a condition of 6° C./minute, and then hydrochloric acid was added to adjust the pH to 2.0, followed by terminating stirring. Formed toner particles were isolated via solid-liquid separation and then washing with ion-exchanged water was repeated 4 times (the amount of ion-exchanged water was 15 litter), followed by drying with hot air of 40° C. to give cyan toner particles [2].

Hydrophobic silica (number average primary particle diameter of 12 nm; hydrophobic degree of 68) was added to [2] at a ratio of 1% by mass, together with hydrophobic titanium oxide (number average primary particle diameter of 20 nm; hydrophobic degree of 63) at a ratio of 1% by mass, followed by being mixed using "HENSCHEL MIXER" (produced by Mitsui Miike Engineering Co., Ltd.). Thereafter, coarse particles were removed using a sieve of a 45 μm aperture to prepare Cyan Toners [2].

Particle diameter of the cyan toner particles did not change by the addition of the hydrophobic silica.

Production Example of Cyan Toner [3] Through [17]

Cyan toner particles [3] through [17] were prepared in the same manner as Production Example 2 of cyan toner, except that colorant microparticles dispersion liquid [2] through [16]

were employed in place of colorant microparticles dispersion liquid [1], and cyan toner [3] through [17] were produced by treatment with external additive in the same manner as cyan toner Production Example 1. Cyan toners [3] through [13] are examples of the present invention and cyan toners [14] through [17] are comparative examples.

Preparation of Developer

Each of Cyan Toners [1] to [17] was mixed with a ferrite carrier of a volume average particle diameter of 60 μm coated with a silicone resin so that the concentration of each of the toners is 6% by mass to prepare two-component Cyan Developers [1] to [17].

Example 1 to 13, Comparative Example 1 to 4

The cyan a developers [1] through [17] was tested by employing a full color combined printer "bizhub C 6500" (produced by Konica Minolta Business Technologies, Inc.) in a condition of fixing line speed of 310 mm/min (around 65 sheets/min.). A patch image of low brightness color in cyan region (L*=40, hue angle h=210°) and a patch image of high brightness color in cyan region (L*=70, hue angle h=210°) were printed on POD Gloss-Coat 128 g/m$^2$ paper (produced by Oji Paper Co., Ltd.) with a toner amount of 4 g/m$^2$, L*a*b* of coloring characteristics of the patch images were measured, and evaluated by chroma C* calculated by the following formula. The result is summarized in Table 1.

$$\text{chroma } C^* = [(a^{*2} + (b^*)^2]^{1/2}$$

Chroma C* of the patch image of low brightness color in cyan region being 26 or higher is judged as practically acceptable coloring characteristics in low brightness color in cyan region.

Chroma C* of the patch image of high brightness color in cyan region being 40 or higher is judged as practically acceptable coloring characteristics in high brightness color in cyan region.

TABLE 1

| | Toner No. | Production Method | Colorant microparticles dispersion liquid No. | Particle diameter of colorant microparticles | Colorant compound X | Colorant compound Y | mX:mY | Evaluation Result Chroma C* High Brightness Color | Evaluation Result Chroma C* Low Brightness Color |
|---|---|---|---|---|---|---|---|---|---|
| Example 1 | 1 | Pulverization | — | — | (X-1) | (Y-1) | 50:50 | 42 | 44 |
| Example 2 | 2 | | 1 | 89 nm | (X-2) | (Y-2) | 70:30 | 47 | 40 |
| Example 3 | 3 | *1 | 2 | 78 nm | (X-4) | (Y-2) | 50:50 | 49 | 45 |
| Example 4 | 4 | *1 | 3 | 65 nm | (X-6) | (Y-1) | 50:50 | 52 | 47 |
| Example 5 | 5 | *1 | 4 | 76 nm | (X-6) | (Y-2) | 50:50 | 48 | 46 |
| Example 6 | 6 | *1 | 5 | 101 nm | (X-1) | (Y-1) | 95:5 | 53 | 39 |
| Example 7 | 7 | *1 | 6 | 91 nm | (X-6) | (Y-4) | 50:50 | 49 | 45 |
| Example 8 | 8 | *1 | 7 | 86 nm | (X-1) | (Y-1) | 5:95 | 46 | 50 |
| Example 9 | 9 | *1 | 8 | 82 nm | (X-6) | (Y-5) | 50:50 | 49 | 46 |
| Example 10 | 10 | *1 | 9 | 79 nm | (X-3) | (Y-2) | 50:50 | 42 | 45 |
| Example 11 | 11 | *1 | 10 | 78 nm | (X-1) | (Y-1) | 50:50 | 49 | 47 |
| Example 12 | 12 | *1 | 11 | 173 nm | (X-1) | (Y-1) | 3:97 | 45 | 50 |
| Example 13 | 13 | *1 | 12 | 135 nm | (X-1) | (Y-1) | 98:2 | 54 | 30 |
| Comparative Example 1 | 14 | *1 | 13 | 185 nm | (X-6) | — | 100:0 | 55 | 25 |
| Comparative Example 2 | 15 | *1 | 14 | 204 nm | — | (Y-1) | 0:100 | 39 | 50 |
| Comparative Example 3 | 16 | *1 | 15 | 235 nm | P.B. 15:3* | (Y-1) | 50:50 | 35 | 52 |
| Comparative Example 4 | 17 | *1 | 16 | 240 nm | (X-6) | P.B. 15:3* | 50:50 | 35 | 39 |

*P.B. 15:3 denotes C.I. Pigment Blue 15:3.

*1: Emulsion polymerization and aggregation

The invention claimed is:

1. A cyan toner for developing an electrostatic image comprises cyan toner particles containing a binder resin and a cyan colorant, wherein the cyan colorant comprises colorant compound X represented by Formula (1) and colorant compound Y represented by Formula (2), Formula (1)

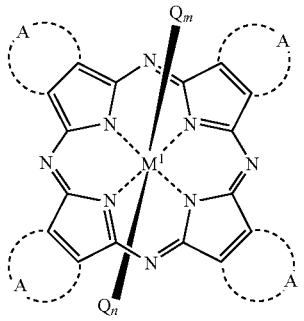

wherein M$^1$ is a metal atom of Group 14, Q is independently a monovalent substituent, m and n are each 0 or 1, at least one of m and n is 1, and A is independently an atomic group forming an aromatic ring which may have a substituent, Formula (2)

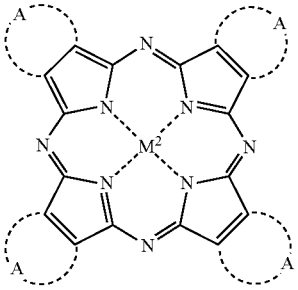

wherein, $M^2$ is Zn or Al, and A is independently an atomic group forming an aromatic ring which may have a substituent.

2. The cyan toner of claim 1, wherein $M^1$ in Formula (1) is Si, Ge or Sn.

3. The cyan toner of claim 2, wherein $M^1$ in Formula (1) is Si.

4. The cyan toner of claim 1, wherein each of Q in Formula (1) is an alkyl group, an aryl group, an aryloxy group, an alkoxy group, an aryloxy group or a group represented by Formula (3), independently, Formula (3)

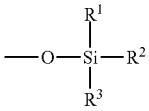

in Formula (3), $R^1$ through $R^3$ represents independently an alkyl group, an aryl group, an aryloxy group or an alkoxy group.

5. The cyan toner of claim 1, wherein a ratio of content by mass mX of the colorant compound X to content by mass mY of colorant compound Y, mX:mY is 95:5 to 5:95.

6. The cyan toner of claim 1, wherein Q in Formula (1) is independently —$OC_4H_9$(t), —$OC_8H_{17}$(t), —$OSi(CH_3)_3$, —$OSi(CH_2CH_3)_3$ or —$OSi(CH_2CH_2CH_3)_3$.

7. The cyan toner of claim 1, wherein A in Formula (1) or Formula (2) is selected from the group consisting of (A-1) to (A7)

(A-1)

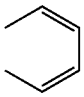

(A-2)

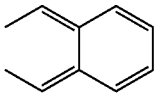

(A-3)

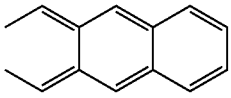

-continued (A-4)

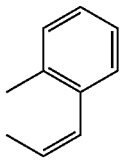

(A-5)

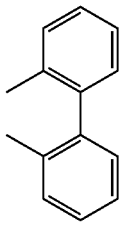

(A-6)

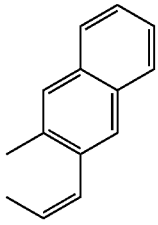

(A-7)

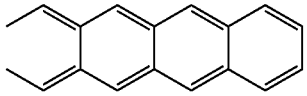

8. The cyan toner of claim 7, wherein A in Formula (1) is selected from the group consisting of (a-1) to (a-7)

(a-1)

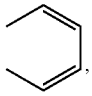

(a-2)

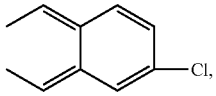

(a-3)

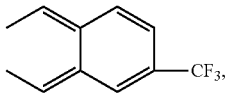

(a-4)

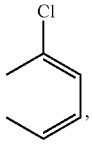

(a-5)

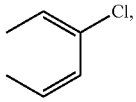

-continued
(a-6)
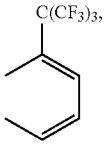
(a-7)
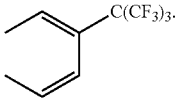
9. The cyan toner of claim 8, wherein A in Formula (1) is selected from the group consisting of (a-1) to (a-3).
10. The cyan toner of claim 1, wherein $M^2$ in Formula (2) is Zn.
11. The cyan toner of claim 1, wherein A in Formula (2) is (a-1), (a-8) or (a-9)
(a-1)
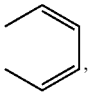
(a-8)
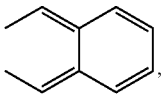
(a-9)
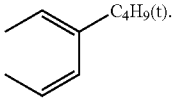
12. The cyan toner of claim 1, wherein the colorant compound represented by Formula (1) is selected from the group consisting of (X-1) to (X-6)
(X-1)
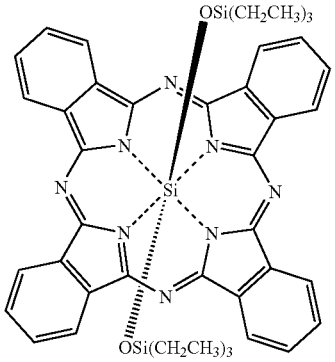
-continued
(X-2)
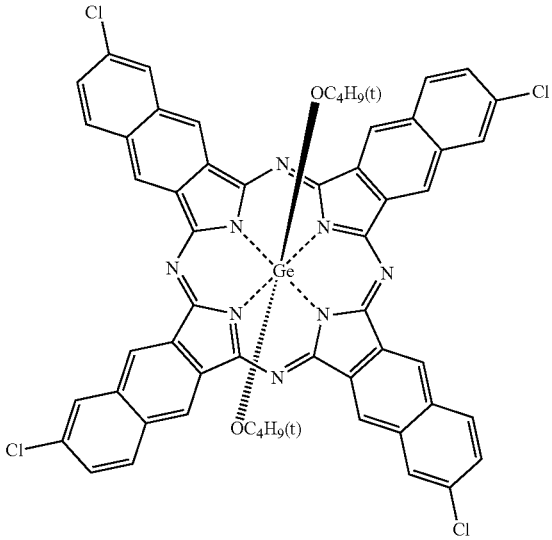
(X-3)
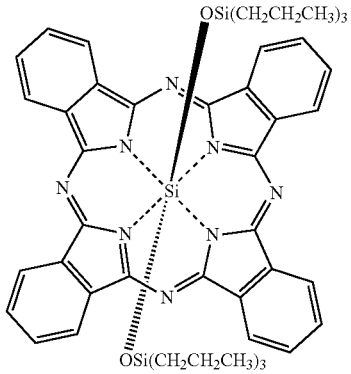
(X-4)
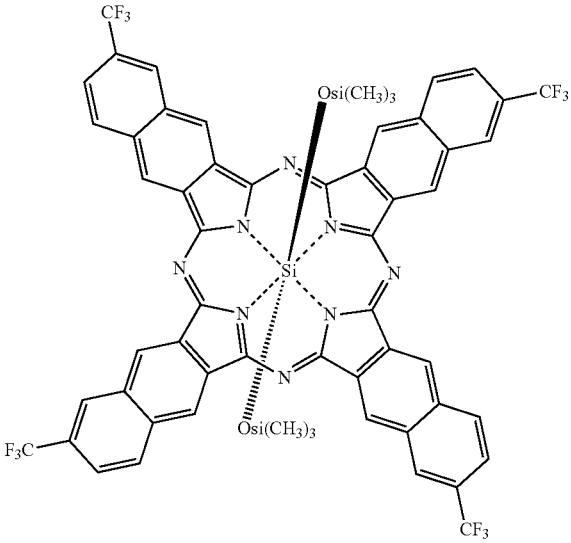

-continued
(X-5)
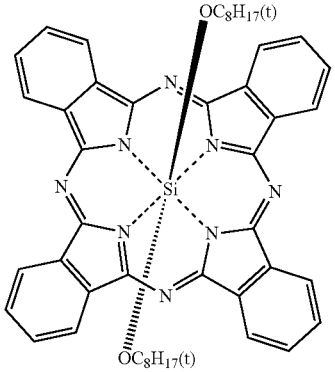
(X-6)
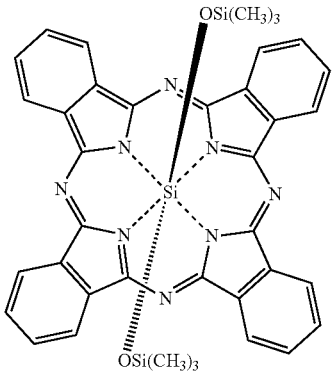
13. The cyan toner of claim 1, wherein the colorant compound represented by Formula (2) is selected from the group consisting of represented by (Y-1) to (Y-5)
(Y-1)
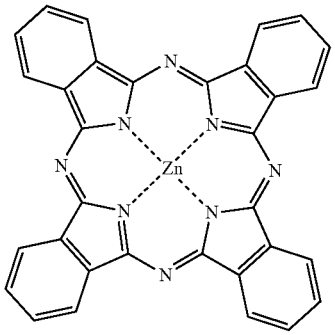
(Y-2)
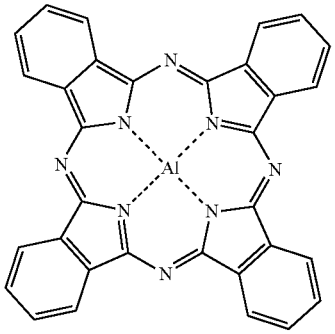
-continued
(Y-3)
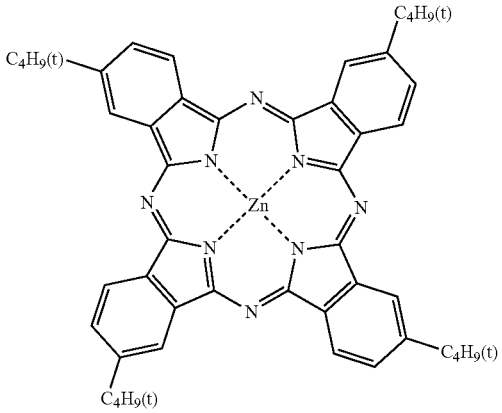
(Y-4)
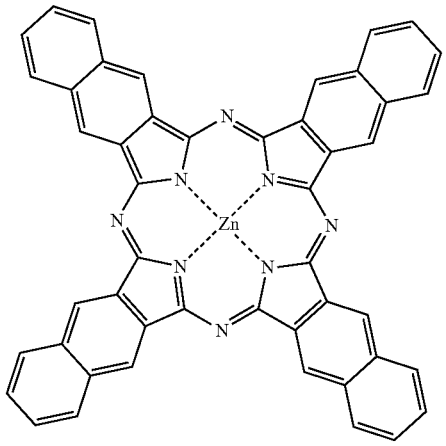
(Y-5)
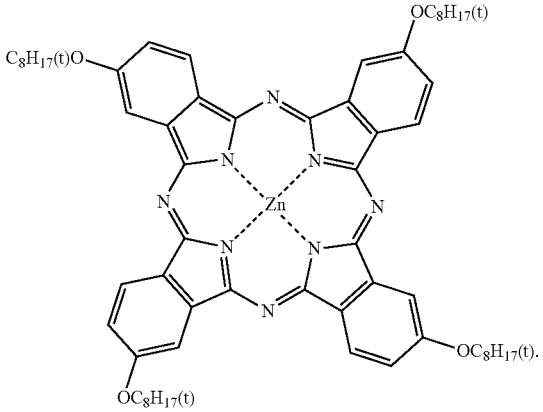
* * * * *